United States Patent [19]

Huang et al.

[11] Patent Number: 4,660,395

[45] Date of Patent: Apr. 28, 1987

[54] DOOR LOCK

[76] Inventors: Kung-Da Huang; Yin-Chiao Yang, both of No. 86, Chung Cheng S. Rd., Yung Kang Village, Tainan Hsien; Jung-Tarng Huang, No. 39, Lane 33, Sec. 2, Chin Hua Rd.; Shen-Li Fu, 7F-5, No. 298, Sec. 2, Chung-Hua Rd., both of Tainan, all of Taiwan

[21] Appl. No.: 884,177

[22] Filed: Jul. 9, 1986

[51] Int. Cl.[4] ..... E05B 27/00

[52] U.S. Cl. ..... 70/351; 70/223; 70/378

[58] Field of Search ..... 70/218, 221, 222, 223, 70/350, 348, 351, 352, 363, 376, 378, 392

[56] References Cited

U.S. PATENT DOCUMENTS 2,497,328 2/1950 Smith ..... 70/223

3,780,548 12/1973 Anastasov ..... 70/352

3,992,907 11/1976 Pilvet ..... 70/222

*Primary Examiner*—Robert L. Wolfe

*Attorney, Agent, or Firm*—Berman, Aisenberg & Platt

[57] ABSTRACT

A door lock includes a latch bolt assembly, and two rotary knobs connected to the latch bolt assembly. A press key is incorporated in one of the handle members and a key-operated lock is incorporated into the other knob. A clutch member is employed to connect and disconnect the latch bolt assembly to and from an actuating member which can engage with and disengage from a locking plate of the lock. The actuating member disengages from the clutch member and engages with the locking plate when the press key is depressed. When the lock is operated by a key, the actuating member is released from the locking plate and engages again with the clutch member.

7 Claims, 5 Drawing Figures

A—A

DOOR LOCK

BACKGROUND OF THE INVENTION

This invention relates to a door lock, and particularly to a door lock of the type which includes a latch bolt assembly adapted to be mounted in a door panel, and two rotary knob connected to two side of the latch bolt assembly on two side of the door panel, one of the knob having a press key to be depressed so as to place the lock in a locking position and the knob having a key-operated lock member used to open the door lock.

SUMMARY OF THE INVENTION

An object of the invention is to provide an improved door lock of the above-described type with a smplified construction.

The present invention provides a door lock which comprises: a latch bolt assembly; a first rotary handle member connected to one side of the latch assembly and having a key-operated rotary lock body which includes a locking plate with an engaging opening therein; a second rotary knob connected to the other side of the latch assembly; an actuating member extending from the first rotaty knob to the second rotary handle member and having one end portion capable of extending through the engaging opening, the portion having an engaging hook to engage with the engaging opening; a clutch member connected to the latch bolt assembly and engaging releasably with the actuating member; a press key incorporated in the second rotary handle member and connected to the actuating member, the press key, opon being depressed, disengaging the actuating member from the clutch member and causing the hook to be engaged with the engaging opening; and a first spring means urging the actuating member to cause the actuating member to engage with the clutch member; whereby, when the lock body is operated by a key, the actuating member is released from the locking plate and then engages with the clutch member to actuate the latch bolt assembly.

In one aspect of the invention, the configuration of the engaging opening is so chosen that the engaging opening can release the engaging hook when the actuating rod is turned to a predetermined angle from a engaged position.

In another aspect of the invention, the key-operated lock body includes; a rotary lock body having a plurality of axial tumbler holes distributed diametrically, axial key holes aligned axially and communicated with the tumbler holes respectively and opening at one end of the lock body for receiving key bits, and a recess extending diametrically in the lock body and intersecting the tumbler holes; a locking plate movably received in the recess and having tumbler openings which are intercommunicated and in alignment with the tumbler holes, and an engaging opening; a second spring means urging the locking plate to an engaging position with the engaging hook of the actuating member; and tumbler pins each with a constricted portion extending in the tumbler holes and the tumbler openings respectively and normally biassed towards the key holes respectively to cause the constricted portions to be out of alignment with the tumbler openings so as to immobilize the locking plate, the tumbler pins being capable of being depressed by a key to place the constricted portions in an aligned position with the tumbler openings so as to allow the locking plate to move, and the tumbler pins having at least one camming tumbler pin which has a tapered portion adjacent to the constricted portion to cam the locking plate to move against the spring means so as to release the engaging hook of the actuating member.

In still another aspect of the invention, the actuating member includes an actuating rod extending axially from the first knob to the second handle member, and an actuating body sleeved fixedly around the actuating rod in the first knob and having a portion bearing gear teeth on its periphery.

In still another aspect of the invention, the clutch member has a hollow member disposed around the actuating body and connected to the latch bolt assembly, the hollow member incorporating an internal clutch gear to engage with the gear teeth.

In still another aspect of the invention, the camming tumbler pin has a cylindrical portion and bears the constricted portion and the tapered portion at one end thereof. Each of the remaining tumbler pins has a cylindrical portion and bears the constricted portion between two ends thereof.

In still another aspect of the invention, the tumbler openings includes spaced apart circular openings having a dimension approximate to that of the cylindrical portion of the tumbler pins. the circular openings arae interconnected by narrow openings which have a dimension smaller than that of the cylindrical portion but greater than that of the constricted portion.

The present exemplary preferred embodiment will be described in detail with reference to the following drawings, in which:

DETAILED DESCRIPTION OF THE PREFERRED EMBODIMENT

Figure 1:
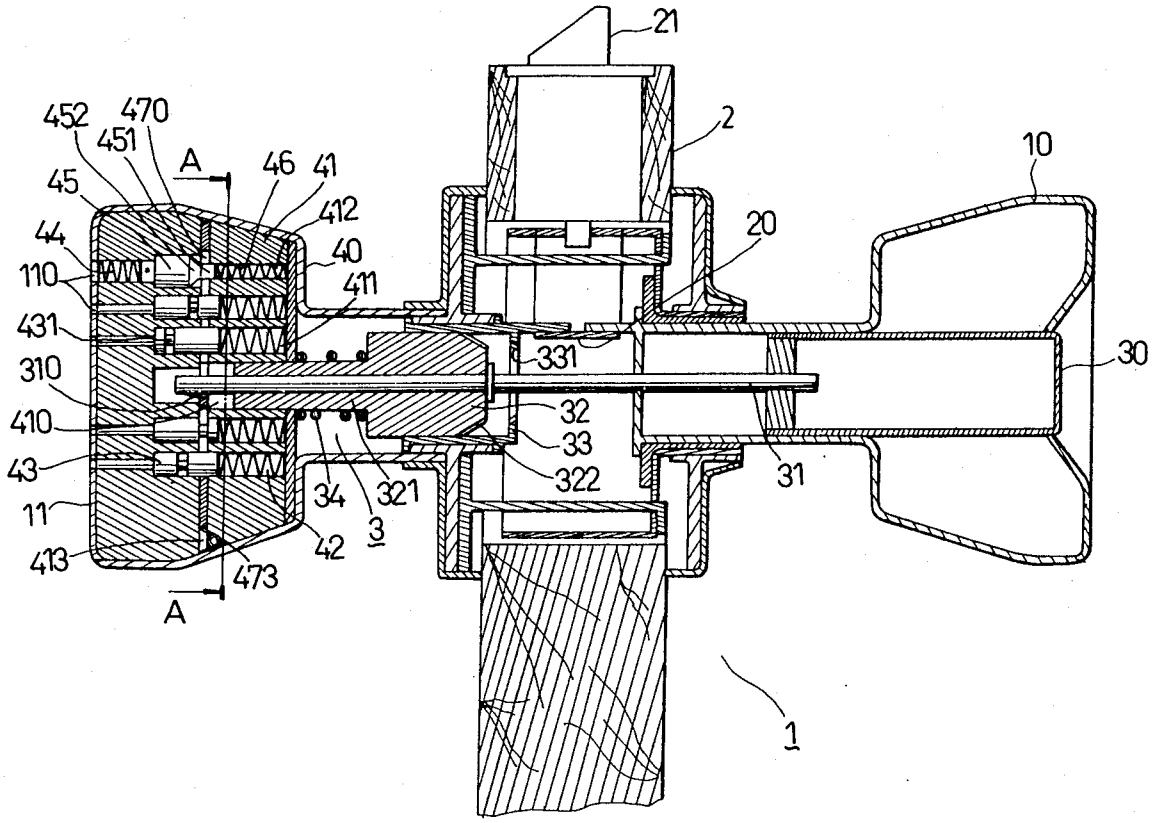
FIG. 1 is a sectional view of a door lock according to the present invention.
Figure 2:
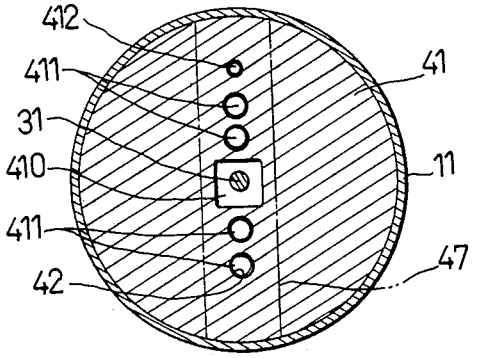
FIG. 2 is a sectional view taken along line A—A of FIG. 1.
Figure 3:
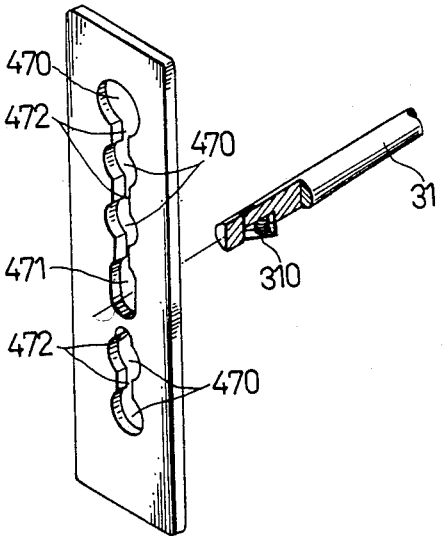
FIG. 3 is a perspective view of a locking plate of the door lock of FIG. 1.

Referring to FIGS. 1–4, there is shown a lock 1 constructed according to the present invention, which includes a latch assembly that can be mounted in a door panel, a first rotary knob 11 and a second rotary knob 10. The second and first handle members 10 and 11 are provided at two sides of the latch assembly 2 which includes a latch 21 and a driven mechanism 20. The driven mechanism 20 is connected to the second knobs 10 which drives the driven mechanism 20 to move the latch 21 to a locking position or an unlocking position. Since the construction of the latch assembly 2 is known and does not form any part of the invention, the details thereof will not be described herein.

The second knob 10 incorporates a press key 30 which is connected to an actuating rod 31 which extends movably through the latch assembly 2 to the first knob 11. An actuating body 3 is sleeved fixedly on a portion of the actuating rod 31 which extends into the first knob 11. The actuating body 3 has a head portion 32 which is provided with bevel gear teeth 322 and a neck portion 321 of rectangular cross-section of which a porton extends into a lock body 41 disposed in the first knob 11. A hollow clutch member 33 is sleeved around the head portion 32 of the actuating body 3 and has a clutch gear 331 to engage with the gear teeth 322 of the actuating body 32. The clutch member 33 is further connected to the driven mechanism 20 of the latch assembly 2 so that, when the gear teeth 322 of the actuating body 3 engage with the clutch gear 331 and the actuating body 3 is rotated, the latch bolt 21 will move.

The lock body 41 is received in a head portion 40 of the handle member 11, and is provided with a plurality of axial tumbler holes 411 and 412 and a central bore 410 of rectangular cross-section for movably receiving the neck portion 321 of the actuating body 3. The tumbler holes 411 and 412 open at one end of the lock body 41 and are covered by a plate 415.

Further, a recess 413 extends diametrically in the lock body 41 intersecting the holes 410, 411 and 412 to receive movably a locking plate 47 which includes a central engaging opening 471 to be in registration with the central hole 410 for extension of the actuating rod 31 therethrough. Tumbler openings 470 are provided on two sides of the engaging opening 471. They are substantially circular and interconnected by narrow openings 472. A spring means 473 is provided at one end of the locking plate 47 to urge it to a position in which the tumbler openings 470 are in alignment with the tumbler holes 411 and 412 respectively. There are key bit holes 110 extending axially in the lock body 41, which open at one end of the lock body 41 for access by the key bits and communicate respectively with the tumbler holes 411 and 412. The key bit holes 110 are smaller in cross-section than the tumbler holes 411 and 412.

Tumbler pins 43 and 45 are disposed respectively in the tumber holes 411 and 412. Each tumbler pin 43 is substantially cylindrical and has a sharply constricted portion 431. The circular tumbler openings 470 have a dimension approximate to that of the cylindrical portion of the tumbler pins 43 so that, when the cylindrical portions of the tumbler pins 43 are in the circular tumbler openings 470, the locking plate is immovable. The narrow openings 472 have a dimension smaller than that of the cylindrical portions of the tumbler pins 443 but greater than that of the constricted portions of the tumbler pins 43 so that, when the constricted portions are in the tumbler openings of the locking plate 47, the locking plate 47 becomes movable. When no key is inserted in the key holes 11, each tumbler pin 43 is normally biassed by a spring 42 against a shoulder formed between the respective tumbler hole 411 and key bit hole 110 so that the constricted portion 431 is out of alignment with the circular tumbler opening 470.

The tumbler pin 45 is substantially cylindrical and has a constricted portion 451 with a tapered portion 452. A spring 46 is disposed in a narrower portion of the tumbler hole 412 to urge normally the tumbler pin 45 against a shoulder formed between the respective ket bit hole 110 and tumbler hole 412. Thus, when no key is inserted in the key bit holes 110, the constricted portion 451 of the tumbler pin 45 is in the respective tumbler opening 470 of the locking plate. When a key is inserted, the tumbler pin 45 retracts, camming a portion of the edge surrounding the respective tumbler hole 470 to move the locking plate 47 against the spring 473. In the key hole 110 which is communicated with the tumbler hole 412 is further disposed a spring 44 in connection with the tumbler pin 45.

There is a press key 30 incorporated into the second knob 10 and connected to an end of the actuating rod 31. A spring 34 is provided around the neck portion 321 between the plate 415 and the head portion 32 of the actuating body for urging the head portion 32 to engage with the the clutch member 33. The other end of the actuating rod 31 adjacent to the actuating body 3 is provided with a spring-biassed engaging hook 310 which can extend into and engage with the engaging opening 471 when the press key 30 is depressed to move the actuating rod 31 against the urging of the spring 34. In this situtation, the head portion 32 of the actuating body 3 disengages from the clutch gear 331.

In operation, the press key 30 is depressed in order to place the door lock 1 in a locking position in which the head portion 32 of the actuating body 3 disengages from the clutch gear 331. The engaging hook 310 extends into the engaging opening 471 of the locking plate 47 and engages with a portion of the edge surrounding the opening 471. In this situation, if the knob 11 is rotated, the actuating body 3 will rotate without moving the latch bolt 21. The lock 1 can be opened when the key 50 is inserted into the key bit holes 110. The key bits 51 press the tumbler pins 43 and 45 against the springs 42 and 46 respectively, placing the constricted portions 431 of the tumbler pins 43 in alignment with the tumbler openings 470 of the locking plate 47. Due to the presence of the spring 44, the tumbler pin 45 begins to retract only after the locking plate 47 becomes movable, and cams concurrently the locking plate 47 to move against the force of the spring 473, thereby releasing the hook 310 from the engaging opening 471. As soon as the hook 310 is released, the actuating body 3 engages again with the clutch member 33, and the lock body 41 is placed in the unlocking position.

Figure 5:
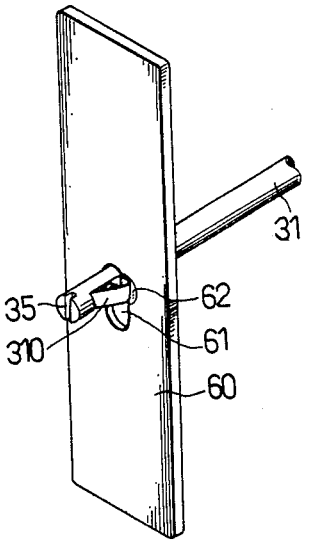
FIG. 5 is an alternative locking plate to be used in the invention.
Figure 4:
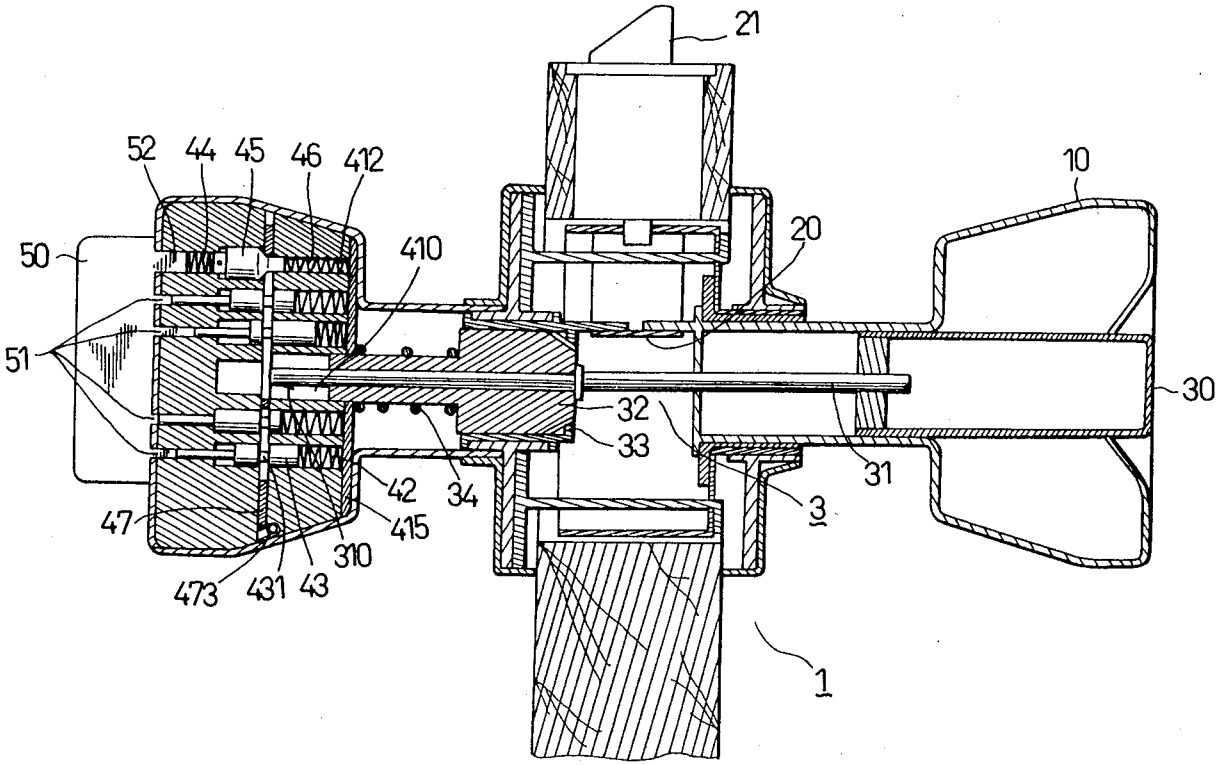
FIG. 4 is a sectional view of the door lock of FIG. 1 which is opened by means of a key.

Alternatively, another form of the key-operated lock body can be incorporated into the door lock according to the present invention instead of the lock body 41. The key-operated lock body may include a locking plate 60 which is shown in FIG. 5 to be incorporated into a suitable door lock having tumbler pins and tumbler holes. The actuating rod 31 can extend through the opening 61 and its engaging hook 310 can engage with an engaging portion 62 of the locking plate 60. The end of the actuating rod 31 is provided with a key groove 35 through which the actuating rod 31 can be rotated to cause the hook 310 to release from the opening 61 of the locking plate 60.

With the invention thus explained, it is apparent that various modifications and variations can be made without departing from the scope of the invention. It is therefore intended that the invention be limited as indicated in the appended claims.

What I claim is:

1. A door lock comprising:

a latch bolt assembly;

a first rotary knob connected to one side of said latch assembly and having a key-operated rotary lock body which includes a locking plate, said locking plate having an engaging opening;

a second rotary knob connected to an other, opposite side of said latch assembly;

an actuating member extending from said first rotary handle member to said second rotary handle member and having one end portion capable of extending through said engaging opening, said one end portion having a resilient engaging hook to engage with said engaging opening;

a clutch member connected to said latch bolt assembly and engaging releaseably with said actuating member;

a press key incorporated in said second rotary knob and connected to said actuating member, said press key, upon being depressed, disengaging said actuating member from said clutch member and causing said hook to be engaged with said engaging opening; and a first spring means urging said actuating member to cause said actuating member to engage with said clutch member, whereby, when said lock body is operated by a key, said actuating member is released from said locking plate and then engages with the clutch member to actuate said latch bolt assembly.

2. A door lock as claimed in claim 1, wherein said engaging opening is in an oblong shape such that said engaging opening can releases said engaging hook when said actuating rod is turned to a predetermined angle from an engaged position.

3. A door lock as claimed in claim 1, wherein said key-operated lock body is a rotary lock body which includes:

a plurality of axial tumbler holes distributed diametrically, axial key holes aligned axially and communicated with said tumbler holes respectively and opening at one end of said lock body for receiving key bits, and a recess extending diametrically in said lock body and intersecting said tumbler holes;

a locking plate movably received in said recess and having tumbler openings which are intercommunicated and which can be in alignment with said tumbler holes, and an engaging opening;

a second spring means urging said locking plate to an engaging position with said engaging hook of said actuating member; and tumbler pins each with a constricted portion extending in said tumbler holes and said tumbler openings respectively and normally biassed towards said key holes respectively to cause said constricted portions to be out of alignment with said tumbler openings so as to immobilize said locking plate, said tumbler pins capable of being depressed by a key to place said constricted portions in an aligned position with said tumbler openings so as to allow said locking plate to move, said tumbler pins having at least one camming tumbler pin which has a tapered portion adjacent to said constricted portion to cam said locking plate to move against said spring means so as to release said engaging hook of said actuating member.

4. A door lock as claimed in claim 3, wherein said actuating member includes an actuating rod extending axially from said first knob to said second knob, and an actuating body sleeved fixedly around said actuating rod in said first handle member and having a portion bearing gear teeth of its periphery.

5. A door lock as claimed in claim 4, wherein said clutch member has a hollow member disposed movably around said actuating body and connected to said latch bolt assembly, said hollow member incorporating an internal clutch gear to engage with said gear teeth.

6. A door lock as claimed in claim 5, wherein said camming tumbler pin has a cylindrical portion and bears said constricted portion and said tapered portion at one end of said camming tumbler pin, and each of the at one end of said cylindrical portion of said camming tumbler pin, and each of the remaining tumbler pins has a cylindrical portion and bears said constricted portion between two ends said cylindrical portion of said remaining tumbler pin.

7. A door lock as claimed in claim 6, wherein said tumbler openings includes spaced apart circular openings having a dimension approximate to that of said cylindrical portion of said tumbler pins, said circular openings being interconnected by narrow openings which have a dimension smaller than that of said cylindrical portion but greater than that of said constricted portion.

* * * * *